United States Patent [19]

Poulenard et al.

[11] Patent Number: 4,901,389

[45] Date of Patent: Feb. 20, 1990

[54] GRAFTING PROCESS, ENSURING WATERPROOFING, OF A POLYMERIC MATERIAL BY A FLUORINATED MONOMER AND MATERIAL OBTAINED THEREBY

[75] Inventors: Jacques Poulenard; Louis Gavet, both of Lyon; Roger Chatelin, Lissieu per Lozanne; Annie Giorgio, Villeurbanne, all of France

[73] Assignee: Institut Textile De France, Boulogne Billancourt, Cedex, France

[21] Appl. No.: 181,728

[22] Filed: Apr. 14, 1988

[30] Foreign Application Priority Data

Apr. 14, 1988 [FR] France ..... 8705308

[51] Int. Cl.[4] ..... C08F 259/00; C08F 271/02; D06M 14/22; D06M 14/26

[52] U.S. Cl. ..... 8/115.63; 8/115.52; 8/115.53; 8/115.64; 525/276; 525/279

[58] Field of Search ..... 8/115.52, 115.53, 115.63, 8/115.64; 525/426, 276, 279; 526/245

[56] References Cited

U.S. PATENT DOCUMENTS 3,634,022 1/1972 Robbins ..... 8/127.51
3,716,391 2/1973 Hosoda et al. ..... 525/276

FOREIGN PATENT DOCUMENTS 1230487 9/1967 France .
2148432 3/1973 France .

*Primary Examiner*—Jacob Ziegler
*Attorney, Agent, or Firm*—Shenier & O'Connor

[57] ABSTRACT

The grafting reaction according to the invention occurs after having impregnated the polymeric material, on which were previously created free radicals by activation within an emulsion containing the fluorinated monomer and a graftable derivative of the morpholine. The preferred reagents are morpholinoethyl methacrylate and 3,3,4,4,5,5,6,6,7,7,8,8,8-tridecafluorooctyl methacrylate. The invention is applicable to the waterproofing of textile articles, particularly made of cotton, silk, linen. The material thus grafted is waterproof when cold, but when hot, it may be washed, dyed or printed by transfer.

9 Claims, No Drawings

GRAFTING PROCESS, ENSURING WATERPROOFING, OF A POLYMERIC MATERIAL BY A FLUORINATED MONOMER AND MATERIAL OBTAINED THEREBY

The present invention relates to a process for grafting a polymeric material by a fluorinated monomer with a view to rendering it water-repellant. More particularly, the invention concerns a process for grafting a fibrous material, in any form whatsoever, particularly textile, such as cotton, linen, wool, silk, polyamide, in order to render it waterproof.

Grafting of a polymeric material by a fluorinated monomer in order to increase its water-repellant character is known in the prior art. Mention may be made of U.S. Pat. No. 3,912,449 which describes such a process of grafting applied to a cellulosic textile material. In this Patent, activation of the cellulosic support is effected by radiation exposure in an inert atmosphere to a dose of one megarad, the radiated textile is immersed in a solution of methanol (73% by volume) and of water (18% by volume) containing as fluorinated monomer hexafluoroisopropyl acrylate (9% by volume), then it is stored for a period of time ranging from 15 minutes to 8 hours at ambient temperature, before being washed with methanol in order to extract therefrom the monomer or the non-grafted homopolymers. According to this process, the grafting rate necessary for obtaining a significant repellant character is high since it is included between about 11 and 58%, the grafting rate here being defined as the gain in weight due to the graft with respect to the weight of the nongrafted material.

It should be emphasized that the textile articles rendered waterproof by coating of fluorinated resins or even by grafting of fluorinated monomers, as is the case in U.S. Pat. No. 3,912,449, present an irreversible repellant character. Once rendered waterproof, the article can no longer be dyed or printed by transfer, the fluorinated product reducing or eliminating the wettability of the article.

A process for grafting a polymeric material by a fluorinated monomer has now been found, and this forms the subject matter of the invention, which overcomes the drawbacks observed in the prior art. The process of the invention is of known type in that free radicals are created on the material by activation, the material is impregnated with a bath containing the fluorinated monomer then the grafting reaction is left to develop for a given period of time. It is characterized in that the bath containing the fluorinated monomer is an emulsion containing a graftable derivative of morpholine. It has been unexpectedly observed that the presence of a graftable derivative of morpholine made it possible to obtain an aqueous emulsion of a fluorinated monomer, simple to employ and stable in time. The grafting according to the process of the invention is in fact a cografting which simultaneously employs the fluorinated monomer and the graftable derivative of morpholine. It appears that the derivative of morpholine also performs the role of solvent of the fluorinated monomer. The term emulsion is used in the present specification even if, at certain concentrations of monomers, the mixture obtained is like a solution.

Among the graftable derivatives of morpholine, morpholinoethyl acrylate ($C_9H_{15}NO_3$) and morphoinoethyl methacrylate ($C_1OH_{17}NO_3$) have been retained in particular. In the following specification, the latter derivative will be designated by MEMA; its structural formula is as follows:

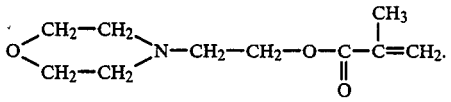

Among the fluorinated monomers laced in emulsion thanks to the derivative of morpholine, 3,3,4,4,5,5,6,6,7,7,8,8,8-tridecafluorooctyl methacrylate has been retained in particular, which will be designated in the following specification by FOMA and of which the structural formula is as follows:

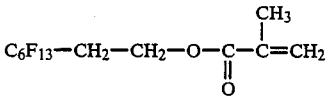

The bath for impregnating the textile article is advantageously an emulsion made by adding to the fluorinated monomer the graftable derivative of the morpholine in the presence of at least one surfaceactive agent, then by adding, with mechanical stirring, the desired quantity of water. The molar ratio of the graftable derivative of the morpholine and the fluorinated monomer is preferably of the order of two. In the case of MEMA and of FOMA, this molar ratio corresponds to a ratio by weight substantially equal to the unit. The total concentration by weight of the derivative of morpholine and of the fluorinated monomer in the emulsion is preferably included between 0.5 and 10%.

The activation necessary for the creation of free radicals on the material is of a known type, selected as a function of the material to be grafted. It is effected for example by action of ozone on a cellulosic material, cotton or linen. It will be effected by action of hydrogen peroxide or ammonium persulfate, in an acid medium, on silk or wool. The hydrogen peroxide or ammonium persulfate is added to the emulsion of which the pH was advantageously adjusted between about 2 and 3. Said activation may also be effected by prior radiation exposure of the material to accelerated electrons.

A further object of the present invention is the material grafted according to the process set forth hereinabove. This polymeric material is characterized in that it comprises grafts including fluorinated groups and morpholine groups. The quantity of grafts present in the structure of the polymeric material is a function of the grafting rate. The grafting rate is defined in the following specification as being the gain in weight of the material due to the grafting with respect to the weight of the grafted material, dry after extraction of the monomer and the non-grafted homopolymers with acetone for 4 hours. The total grafting rate—the grafts including the morpholine groups and the fluorinated groups—is selected as a function of the desired application.

The grafts of the grafted material advantageously comprise groups resulting from the polymerization of the 3,3,4,4,5,5,6,6,7,7,8,8,8-tridecafluorooctyl methacrylate of formula:

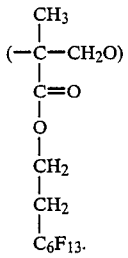

The grafts of the grafted material advantageously comprise groups resulting from the polymerization of morpholinoethyl methacrylate of formula:

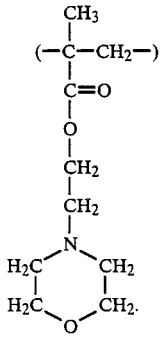

It is yet another object of the invention to propose as application of the process set forth hereinabove, the waterproofing of the grafted material. The repellant character conferred is obtained, contrarily to the example of U.S. Pat. No. 3,912,449 cited hereinabove, as soon as grafting attains a rate of the order of 1%.

However, moreover, it is observed that the grafted material according to the invention, waterproof when cold, is no longer so when it is immersed in a solution taken to a temperature of the order of 60° C., or possibly lower in the presence of surfaceactive agents. In this way, the grafted material according to the invention may undergo any treatments necessitating wettability of the support, then, after treatment, it reuumes its repellant character. Among possible treatments are noted household cleaning (washing in the presence of current detergent products) and textile finishing proper: dyeing, printing by transfer.

Transfer-printing on natural fibers is advantageously improved when there is added into the emulsion containing the fluorinated monomer and the graftable derivative of morpholine, diallyl phthalate as third monomer. The quantity of this third monomer in the emulsion is preferably of the same order as that of the two initial monomers.

The invention will be more readily understood on reading the embodiments given hereinbelow which are examples of the invention and have no limiting character.

EXAMPLE 1

COTTON - ACTIVATION BY OZONE

Each sample of cotton is subjected, in an ozonizer (1.4 ampere, 0.7 bar), to the flux of a mixture of ozone and of oxygen for one hour. It is then immersed in 100 g of an emulsion obtained by mixing 3,3,4,4,5,5,6,67,7,8,8,8-tridecafluorooctyl methacrylate (FOMA), morpholinoethyl methacrylate (MEMA) and a surface-active agent, then by adding the quantity of water necessary to attain the desired concentration of monomers. The sample, spun, is finally treated in a nitrogen atmosphere at 100° C. for a given period of time. Certain operational conditions were modified and give the following results:

EXAMPLE 1a

The ozone/oxygen mixture produced by the ozonizer is with 30 g of ozone per cubic meter. The flux is 400 l/hr. The composition (by weight) of the emulsion is as follows: 0.25% MEMA 0.25% FOMA - 0.03% anionic surface-active agent. Table 1 hereinbelow indicates the grafting rate obtained as a function of the duration of the heat treatment.

Let $P_O$ be the weight of the initial sample, maintained under normal conditions of temperature and humidity (24 hours at 20° C. and 75% relative humidity), $P_1$ the weight of the same sample after grafting and extraction of the monomers and non-grafted homopolymers with acetone for 4 hours, then conditioning. The grafting rate is equal to:

$$t\,\% = \frac{P_1 - P_0}{P_1} \times 100$$

TABLE 1

| Duration of the heat treatment | t |
|---|---|
| 30 minutes | 1.2% |
| 60 minutes | 2.7% |
| 90 minutes | 3.3% |

EXAMPLE 1b

The ozone/oxygen mixture is with 70 g of ozone per cubic meter. The flux is 100 l/hr. The emulsion has the same composition as in Example 1a hereinabove. Table 2 indicates the grafting rate obtained as a function of the duration of the heat treatment.

TABLE 2

| Duration (minutes) | t |
|---|---|
| 30 | 0.7% |
| 60 | 2.6% |
| 90 | 4.4% |

Example 1c

The ozone/oxygen mixture is with 70 g of ozone per cubic meter. The flux is 100 l/hr. The heat treatment occurs at 100° C. for one hour. Table 3 hereinbelow indicates the grafting rate obtained as a function of the concentation (by weight) of the MEMA and of the FOMA in the emulsion.

TABLE 3

| Concentration of the emulsion | | t |
|---|---|---|
| MEMA (%) | FOMA (%) | % |
| 0.8 | 0.2 | 5.52 |
| 0.6 | 0.4 | 6.70 |
| 0.5 | 0.5 | 6.90 |
| 0.4 | 0.6 | 1.14 |

This Example clearly shows the advantage in using a quantity of derivative of morpholine greater than or of the order of that of the fluorinated monomer.

EXAMPLE 1d

Adjustment of the ozonizer is modified: 1.2 ampere, 0.5 bar. The ozone/oxygen mixture is with 22 g of ozone per cubic meter. The flux is 600 l/hr. The heat treatment takes place at 100° C. for one hour. Table 4 hereinafter indicates the grafting rate obtained as a function of the total concentration of monomer in the emulsion. The quantities of MEMA and of FOMA are equal; the emulsion includes a non-ionic surface-active agent at a rate of 10% by weight with respect to the total quantity of monomer.

TABLE 4

| Concentration (%) | t (%) |
|---|---|
| 1 | 5.3 |
| 5 | 22.7 |

EXAMPLE 2

LINEN - ACTIVATION BY OZONE

The ozonizer is adjusted to 1.2 ampere, 0.5 bar. The ozone/oxygen mixture is with 22 g of ozone per cubic meter. The flux is 600 l/hr. Each sample is immersed in an emulsion containing equal quantities of MEMA and FOMA and about 10% of a non-ionic surfaceactive agent with respect to the weight of monomer employed.

The bath ratio is 1:20. The grafting reaction takes place in a nitrogen atmosphere. Heat treatment is for 1 hour at 100° C. Table 5 hereinafter indicates the grafting rate obtained on the samples of linen as a function of the concentration (by weight) of monomer of the emulsion.

TABLE 5

| Concentration (%) | t (%) |
|---|---|
| 0.5 | 1.6 |
| 1 | 5.8 |
| 5 | 13.3 |

EXAMPLE 3

SILK - ACTIVATION BY HYDROGEN PEROXIDE

Emulsions are made containing MEMA and FOMA in equal quantities and a non-ionic surface-active agent at a rate of about 10% (by weight) with respect to the total weight of monomer. The pH of these emulsions is taken to between 2 and 3 by addition of formic acid then a certain quantity of 33% hydrogen peroxide (100 volumes) is added. The bath ratio is 1:25. The grafting reaction takes place in an atmosphere of nitrogen for 1 hour at 100° C.

Table 6 hereinbelow indicates the grafting rate obtained on the samples of silk as a function of the quantity of hydrogen peroxide added to an emulsion containing 1% of monomer.

TABLE 6

| Quantity $H_2O_2$ | t (%) |
|---|---|
| 0.2 ml/100 g | 7.10 |
| 0.4 ml/100 g | 3.97 |
| 0.6 ml/100 g | 3.02 |

The following Table indicates the grafting rate obtained as a function of the concentration of monomer in the emulsion.

TABLE 7

| Concentration (%) | t (%) |
|---|---|
| 0.5 | 2.7 |
| 1 | 6.7 |

EXAMPLE 4

SILK - ACTIVATION WITH AMMONIUM PERSULFATE

Emulsions are made with certain concentrations (by weight) of monomer (MEMA and FOMA in equal quantities) and 10% of a surface-active agent with respect to the total weight of monomer. The persulfate is added into the emulsion, taken to a pH of between 2 and 3 by addition of formic acid. The grafting reaction is conducted for 1 hour at 100° C. without monitoring the environment.

Table 8 hereinbelow indicates the grafting rate obtained on the samples of silk as a function of the quantity of ammonium persulfate added in an emulsion with 1% of monomer, the bath ratio being 1:30.

EXAMPLE 8

| Quantity of persulfate (%) | t (%) |
|---|---|
| 0.1 g/100 g | 2.5 |
| 0.3 g/100 g | 10.4 |
| 0.5 g/100 g | 10.6 |
| 0.7 g/100 g | 9.5 |

Table 9 hereinbelow indicates the grafting rate obtained on the samples of silk as a function of the concentration of monomer, for a quantity of ammonium persulfate equal to 0.3 g per 100 g of emulsion. The bath ratio is 1:25.

TABLE 9

| Concentration (%) | t (%) |
|---|---|
| 0.5 | 5 |
| 0.7 | 8.2 |
| 1 | 9.6 |

EXAMPLE 5

ACTIVATION WITH AMMONIUM PERSULFATE

The sample of wool is in the form of yarn. The emulsion is with 1% of monomer (MEMA and FOMA in equal quantities). The grafting reaction is conducted in a nitrogen atmosphere for 90 minutes at 90° C. The quantity of ammonium persulfate is 0.1 g per 100 g of emulsion, the latter being at a pH included between 2 and 3 by the addition of formic acid. The grafting rate obtained is 10.3%.

EXAMPLE 6

PERMANENCE WITH DRY CLEANING

In order to check the permanence of the waterproof character of the grafted textile materials according to the process of the invention, three samples of cotton, silk and linen were successively grafted, and comparative tests were made before and after dry cleaning in accordance with two methods: the Spray Test according to standard NG G 07 056 and the Schmerber according to standard NG G 07 057.

Grafting was effected on samples previously activated by ozone, impregnated in an emulsion with 1% of MEMA and FOMA in equal quantities by weight, then heated for one hour to 100° C. The samples thus grafted were washed with acetone for 4 hours. The grafting rates obtained are respectively 7.2% for cotton, 9.6% for silk and 6.1% for linen.

Table 10 hereinbelow indicates the values of the Spray Test and of the Schmerber for the starting samples (A) and for the same samples after they have undergone three dry cleanings (B). It should be noted that all the materials non-grafted according to the invention present zero values in the two waterproofing tests.

TABLE 10

| | Spray Test (from 0 to 5) | | Schmerber (in mm) | |
|---|---|---|---|---|
| | A | B | A | B |
| grafted cotton 7.2% | 5 | 4 | 200 | 200 |
| grafted silk 9.6% | 3 | 3 | 325 | 300 |
| grafted linen 6.1% | 4 | 3 | 110 | 100 |

What is claimed is:

1. A process for cografting a polymeric material including the steps of:

(a) forming an aqueous emulsion by adding a fluorinated monomer and a graftable derivative of morpholine in the presence of at least one surface-active agent and mechanically stirring, (b) creating free radicals on the material by activation, (c) impregnating the material with said aqueous emulsion containing the fluorinated monomer and the graftable derivative of morpholine.

2. The process of claim 1, wherein the graftable derivative of morpholine is morpholinoethyl acrylate or morpholinoethyl methacrylate.

3. The process of claim 1, wherein the fluorinated monomer is 3,3,4,4,5,5,6,6,7,7,8,8,8tridecafluorooctyl methacrylate.

4. The process of claim 1, wherein the molar ratio of the graftable derivative of the morpholine and of the fluorinated monomer is of the order of two.

5. The process of claim 1, wherein the total concentration by weight of monomer in the emulsion is included between 0.5 and 10%.

6. The process of claim 1, of the type employing a chemical activation by hydrogen peroxide or ammonium persulfate, wherein the pH of the aqueous emulsion is adjusted to about 2 and 3 before adding the hydrogen peroxide or the ammonium persulfate.

7. A grafted polymeric material comprising polymerized fluorinated groups and morpholine groups into the polymeric material.

8. The material of claim 7, wherein the fluorinated groups result from the polymerization of 3,3,4,4,5,5,6,6,7,7,8,8,8-tridecafluorooctyl methacrylate.

9. The material of claim 7, wherein the morpholine groups results from the polymerization of morpholinoethyl methacrylate or morpholinoethyl acrylate.

* * * * *

UNITED STATES PATENT AND TRADEMARK OFFICE

CERTIFICATE OF CORRECTION

PATENT NO. : 4,901,389

DATED : February 20, 1990

INVENTOR(S) : Jacques Poulenard, Louis Gavet, Roger Chatelin, Annie Giorgio

It is certified that error appears in the above-identified patent and that said Letters Patent is hereby corrected as shown below:

Column 8, line 10 - before "tridecafluorooctyl", insert -- - --.

Column 8, line 24 - delete "into", substitute -- onto --.

Signed and Sealed this

Fourth Day of December, 1990

*Attest:*

HARRY F. MANBECK, JR.

*Attesting Officer*

*Commissioner of Patents and Trademarks*